US006059600A

United States Patent [19]

Vanbesien

[11] Patent Number: 6,059,600

[45] **Date of Patent: *May 9, 2000**

[54] GUIDE PIN FOR ELECTRICAL CONNECTORS

[75] Inventor: Johan Vanbesien, Ypres, Belgium

[73] Assignee: Siemens Aktiengesellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,598

[22] Filed: Sep. 29, 1997

[30] Foreign Application Priority Data

Sep. 27, 1996 [DE] Germany ..... 196 39 943

[51] Int. Cl.[7] ..... H01R 13/64

[52] U.S. Cl. ..... 439/378

[58] Field of Search ..... 439/378, 82, 78, 439/83

[56] References Cited

U.S. PATENT DOCUMENTS

| | | | |
|---|---|---|---|
| 4,030,792 | 6/1977 | Fuerst | 439/82 |
| 4,191,440 | 3/1980 | Schramm | 439/82 |
| 4,659,156 | 4/1987 | Johnescu et al. | 439/378 |
| 4,867,710 | 9/1989 | Harting et al. | 439/82 |
| 5,589,669 | 12/1996 | Downes et al. | 439/82 |

FOREIGN PATENT DOCUMENTS

| | | |
|---|---|---|
| 8904564 | 6/1990 | Germany . |
| 4101035A1 | 7/1992 | Germany . |
| 4407583C1 | 4/1995 | Germany . |

OTHER PUBLICATIONS

"Steckverbinder/Connectors", Siemens Data Book, , pp. 7–59.

*Primary Examiner*—Gary F. Paumen
*Attorney, Agent, or Firm*—Herbert L. Lerner; Laurence A. Greenberg; Werner H. Stemer

[57] ABSTRACT

A guide pin for electrical connectors has an attachment section possessing two zones. Specifically a fastening zone in the form of a sturdy press-fit zone and a guide zone which has a slightly reduced outside diameter as a prepositioning zone for insertion of the guide pin into a mounting hole of an assembly. The guide pin is fastened by further pressing of the guide pin into place.

6 Claims, 2 Drawing Sheets

GUIDE PIN FOR ELECTRICAL CONNECTORS

BACKGROUND OF THE INVENTION

Field of the Invention

The invention relates to a guide pin for electrical connectors, and more specifically, to a guide pin having an attachment section on one end that can be fastened in a mounting hole in an assembly and a pre-engagement guide section on the other end.

Such guide pins are used in the "SIPAC" connector system described in the February 1995 edition of the Siemens Data Book on "Steckverbinder/Connectors", pages 7–59. The "SIPAC" connector system has pins located on both edges of the shorter sides of the male connector body in a connection between a female connector body mounted on an assembly and a male connector body arranged on a rear wall. Each of the pins is fastened in a mounting hole formed in the rear wall. The guide pins provide precentering of the assembly and are also used in combination with special keying parts to key the connection. Moreover, they can be used at the same time for pre-engagement grounding or as initial pre-engagement high-current contacts. In the known connector, the guide pin is formed of a machined part with a flange and an internal thread on the mounting end. The flange of the pin is drawn against and fastened to the rear wall by a screw that is threaded into the internal thread from the far side of the rear wall. The method of assembly and fastening is relatively time-consuming and thus expensive due to the connecting device being configured as a screw.

SUMMARY OF THE INVENTION

It is accordingly an object of the invention to provide a guide pin for electrical connectors, which overcomes the herein-mentioned disadvantages of the heretofore-known devices and methods of that general type, and which simplifies the assembly and fastening of a guide pin to an assembly.

With the foregoing and other objects in view there is provided, in accordance with the invention, a guide pin for electrical connectors to be fastened to an assembly by insertion into a mounting hole formed therein, comprising a pre-engagement guide section; a fastening section for fastening to an assembly has a mounting hole formed therein with a given diameter for receiving the fastening section, the fastening section has a first end and a second end, the first end integral with the guide section; and the fastening section has a fastening zone and a guide zone, the fastening zone has a predetermined diameter and is configured as a sturdy press-fit zone for press-in fastening of the fastening section into the mounting hole, the guide zone has an outside diameter less than the given diameter and less than the predetermined diameter for facilitating an insertion of the guide zone into the mounting hole.

The object is attained with a guide pin of the type described above in that the attachment section of the guide pin has two zones. The first zone (the fastening zone) is configured as a sturdy press-fit zone for press-in fastening of the guide pin into the mounting hole. The other zone (a guide zone) is configured as a prepositioning zone that extends from the press-fit zone to the end of the guide pin and has a reduced outside diameter relative to the press-fit zone for insertion of the guide pin into the mounting hole.

A guide pin of such type is configured with two zones in its fastening section. Specifically it is configured with a prepositioning zone as a guide zone for assisting in the insertion of the guide pin into a mounting hole in the assembly, and with a sturdy press-fit zone for press-in fastening of the guide pin into the mounting hole. With the guide zone having a slightly reduced outside diameter relative to the press-fit zone and to the diameter of the mounting hole, the guide pin can be easily placed in the mounting hole manually or by automated machinery. It is desirable for the guide zone to sit in the mounting hole with minimal play. After its insertion in the mounting hole, the guide pin is positioned in the mounting hole precisely enough that its press-fit zone can be pressed further into the mounting hole by an automatic pressing machine. At the same time, it is possible to automatically press other components of the connector. In that way the assembly time for the guide pin is significantly reduced and the overall assembly and fastening of the guide pin is significantly simplified.

In accordance with an added feature of the invention, the guide zone has an end and an insertion chamfer is formed at the end of the guide zone.

In accordance with an additional feature of the invention, the diameter of the guide zone relative to the given diameter is configured such that the guide zone fits into the mounting hole with very little play.

In accordance with another feature of the invention, the predetermined diameter is slightly oversized with respect to the given diameter.

In accordance with yet another added feature of the invention, the fastening zone has a cross-sectional shape of an equilateral triangle with rounded edges. In an advantageous embodiment of the guide pin in accordance with the invention, the press-fit zone, at a minimum, has a cross-sectional shape that is basically an equilateral triangle with rounded edges instead of pointed edges. The outside diameter of such a guide pin can be manufactured with great precision. It is advantageous for the outside diameter of the guide zone to be slightly oversize with respect to the inside diameter of the mounting hole. The advantage of a press-fit zone with a substantially triangular cross-section is that relatively large tolerances in the inside diameter of the mounting hole can be accommodated with such a press-fit zone.

In accordance with yet another feature of the invention, the rounded edges of the fastening zone has a surface and the surface is formed with a straight knurl in a longitudinal direction of the fastening zone. It is advantageous to provide the rounded edges in the press-fit zone with a straight knurl in the longitudinal direction of the guide pin as this helps in securing the guide pin in the mounting hole. With a press-fit zone of such a configuration, the guide pin can be fastened in mounting holes having varying tolerances and at a relatively constant insertion force.

In accordance with a concomitant feature of the invention, the guide zone has a circular cross-section.

Other features which are considered as characteristic for the invention are set forth in the appended claims.

Although the invention is illustrated and described herein as embodied in a guide pin for electrical connectors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
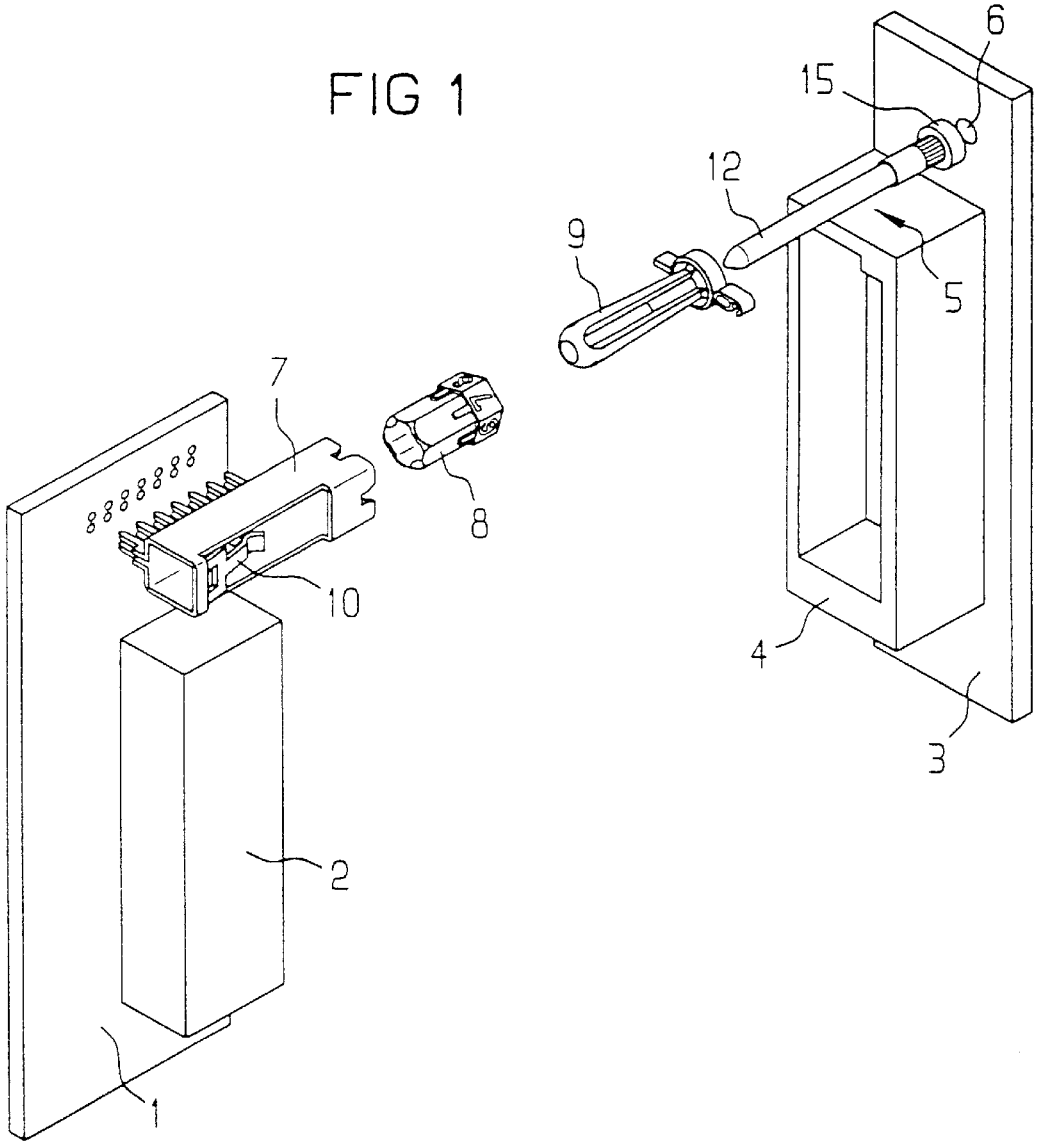
FIG. 1 is a diagrammatic, perspective, exploded view of an electrical connector with a guide pin according to the invention.

Referring now to the figures of the drawings in detail and first, particularly, to FIG. 1 thereof, there is shown a female connector body 2 on a component side of an assembly 1. The female connector body 2, in conjunction with a male connector body 4 located on a front side of a rear wall of an assembly 3, constitutes an electrical connection. At each of the edges on a short side of the male connector body 4 is disposed a guide pin 5 which is fastened into a mounting hole 6 in the rear wall 3. For the sake of simplicity, FIG. 1 only shows the guide pin 5 at one of the edges on the short side of the male connector body 4. Each of the guide pins 5 of the connector acts together with a keying box 7 located at each of the edges on a short side of the female connector body 2 on the assembly 1. FIG. 1 shows only one of these as well. In addition, keying elements 8 and 9 are provided which slide into the keying box 7 or onto the guide pin 5. Those keying elements 8 and 9, in similar manner to the guide pin 5, are likewise not integrated into the male or female connector bodies 2 or 4. The pre-engagement guide pin 5 provides precentering when establishing a connection and makes a pre-engagement contact with a spring 10 contained in the keying box 7 before the male and female connector bodies 2 and 4 make contact. The initial pre-engagement can also be used as a ground or high-current contact.

Figure 2:
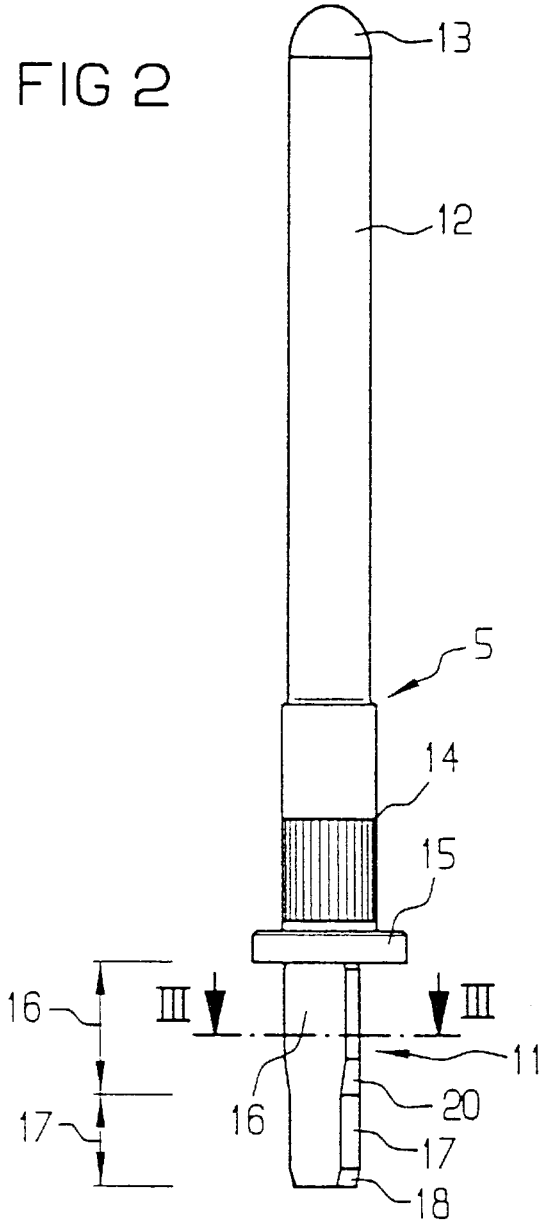
FIG. 2 is an enlarged, top plan view of the guide pin.
Figure 3:
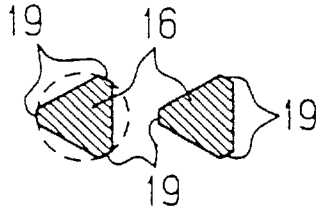
FIG. 3 is a cross-sectional view of the guide pin taken along line III—III shown in FIG. 2, in the direction of the arrows.

The guide pin 5, as shown in FIG. 2, can be turned or rotated as it is inserted into the mounting hole 6 to assist in the insertion process. The guide pin 5 has a fastening section 11 at one end which is fastened in the mounting hole 6 in the rear wall of the assembly 3, and a pre-engagement guide section 12 on the other end. The guide section 12 of the guide pin 5 has a round cross-section and is rounded off at its free end 13. The guide pin 5 has a rear end 14 which faces the rear wall 3. A zone of the rear end 14 is straight-knurled and has a slightly enlarged diameter in relationship to the guide section 12, and the rear end 14 is adjacent a flange 15 that rests against the rear wall 3 when the guide pin is in its fastened state. The fastening section 11 of the guide pin, adjacent the rear side of flange 15, has two zones. They are a fastening zone 16 configured as a sturdy press-fit zone for press-in fastening of the guide pin 5 in the mounting hole 6 formed in the rear wall 3 and a guide zone 17 extending from the press-fit zone 16 to the end of the guide pin 5. The guide zone 17 serves as a prepositioning zone during insertion of the guide pin 5 into the mounting hole 6. To facilitate insertion, the guide zone 17 has a slightly reduced outer diameter D1 relative to a diameter D2 of the press-fit zone 16 and is provided with an insertion chamfer 18. The rotatable fastening section 11 initially has a round cross-section throughout its length. In the example embodiment depicted, the outside diameter D2 of the press-fit zone 16 is slightly oversize with respect to an inside diameter d of the mounting hole 6, while the guide zone 17 has an outside diameter Dl slightly less than the diameter D2 of the press-fit zone 16 and is dimensioned such that the guide zone 17 fits into the mounting hole 6 with very little play. In the depicted example embodiment of a guide pin 5, the entire length of fastening section 11 has essentially the cross-sectional shape of an equilateral triangle, with rounded areas 19 instead of corners as shown in FIG. 3. The triangular form of the fastening section 11, which was originally circular in cross-section, as shown by dashed lines in FIG. 3, is produced by a machining process, for example by milling. To facilitate the pressing of the guide pin 5 into the mounting hole 6, there is a small sloped transition region 20 at the end of the press-fit zone 16 added to the fastening section 11 when the fastening section 11 is configured with a triangular cross section over its entire length.

When the guide pin 5 is pressed in by a pressing tool, the flange 15 of the guide pin 5 also serves as a pressing shoulder. After a manual or an automated insertion of the guide pin 5 into the mounting hole 6, the pressing-in process is quickly and easily accomplished. In that way, the assembly and fastening of the guide pin 5 to the rear wall 3 can be made significantly simpler and less expensive than would be the case for a guide pin with a threaded attachment.

With the guide pin 5 depicted, it is also possible to provide rounded edges 19 in the press-fit zone 16 with a straight knurl in the longitudinal direction of the guide pin 5. In a manner differing from the embodiment depicted, it is also possible to leave the guide zone 17 circular in cross-section, and to configure the press-fit zone 16 with the slightly larger outside diameter D2 and to provide only the press-fit zone 16 with a triangular cross-section.

I claim:

1. A guide pin for electrical connectors to be fastened to an assembly by insertion into a mounting hole formed therein, comprising:

a pre-engagement guide section having a cross sectional area;

a fastening section for fastening to an assembly having a mounting hole formed therein with a given diameter for receiving said fastening section, said fastening section having a first end and a second end, said first end integral with said guide section; and said fastening section having a fastening zone and a guide zone, said fastening zone having a predetermined diameter and configured as a sturdy press-fit zone for press-in fastening of said fastening section into the mounting hole, said guide zone having an outside diameter less than said given diameter and less than said predetermined diameter for facilitating an insertion of said guide zone into the mounting hole, said fastening zone having a cross-sectional shape of an equilateral triangle with rounded edges, said fastening zone having a cross sectional area being less than said cross sectional area of said pre-engagement guide section.

2. The guide pin according to claim 1, wherein said guide zone has an end and an insertion chamfer is formed at said end of said guide zone.

3. The guide pin according to claim 1, wherein said diameter of said guide zone relative to the given diameter is configured such that said guide zone fits into the mounting hole with very little play.

4. The guide pin according to claim 1, wherein said predetermined diameter is slightly oversized with respect to the given diameter.

5. The guide pin according to claim 1, wherein said rounded edges of said fastening zone have a surface and said surface is formed with a straight knurl in a longitudinal direction of said fastening zone.

6. The guide pin according to claim 1, wherein said guide zone has a circular cross-section.

* * * * *